US007757975B2

(12) United States Patent
Halbleib et al.

(10) Patent No.: US 7,757,975 B2
(45) Date of Patent: Jul. 20, 2010

(54) DEVICE AND METHOD FOR DRYING AND DEAGGLOMERATING

(75) Inventors: Andreas Halbleib, Beckum (DE); Karl Menzel, Ennigerloh (DE); Pedro Guerrero Palma, Lipporg (DE)

(73) Assignee: Polysius AG (DE)

( * ) Notice: Subject to any disclaimer, the term of this patent is extended or adjusted under 35 U.S.C. 154(b) by 243 days.

(21) Appl. No.: 11/909,383

(22) PCT Filed: May 19, 2006

(86) PCT No.: PCT/EP2006/004785

§ 371 (c)(1),
(2), (4) Date: Sep. 21, 2007

(87) PCT Pub. No.: WO2006/131198

PCT Pub. Date: Dec. 14, 2006

(65) Prior Publication Data

US 2008/0189977 A1 Aug. 14, 2008

(30) Foreign Application Priority Data

Jun. 8, 2005 (DE) ..... 10 2005 026 425

(51) Int. Cl.
*B02C 15/00* (2006.01)

(52) U.S. Cl. ..... 241/18; 241/23

(58) Field of Classification Search ..... 241/117–121, 241/189.1, 57, 62, 18, 19, 23
See application file for complete search history.

(56) References Cited

U.S. PATENT DOCUMENTS

| | | | | |
|---|---|---|---|---|
| 1,806,077 | A * | 5/1931 | McMurray | 241/119 |
| 3,556,419 | A | 1/1971 | Frangquist et al. | |
| 4,489,895 | A * | 12/1984 | Petersen | 241/19 |
| 5,971,302 | A | 10/1999 | Doumet | |
| 7,267,293 | B2 * | 9/2007 | Chen et al. | 241/119 |

FOREIGN PATENT DOCUMENTS

| | | |
|---|---|---|
| DE | 205 079 | 12/1983 |
| DE | 195 35 613 | 3/1997 |
| JP | 03127637 | 5/1991 |

* cited by examiner

*Primary Examiner*—Mark Rosenbaum
(74) *Attorney, Agent, or Firm*—Gifford, Krass, Sprinkle, Anderson & Citkowski, P.C.

(57) ABSTRACT

The invention relates to a device and method for drying and deagglomerating moist feed material, whereby the feed material is kneaded, mixed and broken up by the action of at least one roller rolling on a driven plate and is dried by means of hot gas supplied thereto. The invention also relates to a method for converting this device into a mill drying device, whereby the at least one roll is provided with a pressing device.

2 Claims, 8 Drawing Sheets

DEVICE AND METHOD FOR DRYING AND DEAGGLOMERATING

The invention relates to a device and a method for drying and deagglomerating moist feed material, wherein the feed material is kneaded, mixed and broken up by the action of at least one roller rolling on a driven plate and is dried by means of supplied hot gas. The invention also relates to a method of converting the drying and deagglomerating device into a mill drying device.

Wet methods are still frequently used for the processing of raw materials in the cement industry. In this case, the raw material is wet-ground and fed in the form of a slurry to long furnaces. Another solution provides predrying the wet material by means of filter presses and feeding it to beater mills and then further processing it in a two- or three-stage heat exchanger. A further possibility is to inject the slurry directly into a beater mill. In this case, the energy is generated in a single- or two-stage heat exchanger in order to expel the water.

The object of the invention is to propose a different method.

According to the invention, this object is achieved by the features of claims 1, 7 and 11.

The drying and deagglomerating device substantially comprises a driven plate, a roller unit with at least one roller rolling on the plate for the purpose of kneading, mixing and breaking up a feed material, means for supplying hot gas for drying the feed material and means for detaching and breaking up the material bed forming on the plate.

In the method according to the invention for drying and deagglomerating moist feed material, the feed material is kneaded, mixed and broken up by the action of at least one roller rolling on a driven plate and is dried by means of supplied hot gas, wherein the material bed forming on the plate is detached and broken up.

The device and method for drying and deagglomerating are distinguished by very effective treatment of the material.

Further developments of the invention form the subject-matter of the sub-claims.

The device preferably has a stepped air supply in that first means for supplying hot gas are provided in the region of the grinding plate and second means for supplying hot gas are provided in a region above the at least one roller.

With this device, a feed material with a moisture content of 15% to 50% can be processed without any problems. In this case, 70% of the feed material has a particle size of less than 200 μm. Should it be necessary, it is advantageous if feed material which has already been dried is fed back and mixed with the still moist feed material on the grinding plate.

In addition to the efficient working method using moist feed material, the above-described device has the further advantage that, in a corresponding development, it can be converted into a mill drying device in a simple manner at a later point in time. For this purpose, it is provided in particular that the roller is already formed as a grinding roller for later conversion of the device. The plate can also already be constructed as a grinding plate. According to a further development, a pedestal for the drying and deagglomerating device is also provided and is designed so that it can be used for later conversion of the device into a mill drying device.

Principally, when the drying and deagglomerating device is converted into a mill drying device, the at least one roller is provided with a pressing device. Furthermore, the means for detaching and breaking up the material bed forming on the plate are removed and optionally replaced by further roller units with pressing devices. In addition, it can be necessary for the driving device for the plate and the air supply to be adapted to the conditions in a mill drying device.

Further advantages and developments of the invention will be explained in greater detail hereinbelow by means of the description of a number of embodiments.

In the drawings:

FIGS. 1*a* and 1*b* show a schematic side view and plan view of a drying and deagglomerating device according to a first embodiment;

FIGS. 2*a* and 2*b* show a schematic side view and plan view of a drying and deagglomerating device according to a second embodiment;

FIGS. 3*a* and 3*b* show a schematic side view and plan view of a drying and deagglomerating device according to a third embodiment;

Figure 9A:
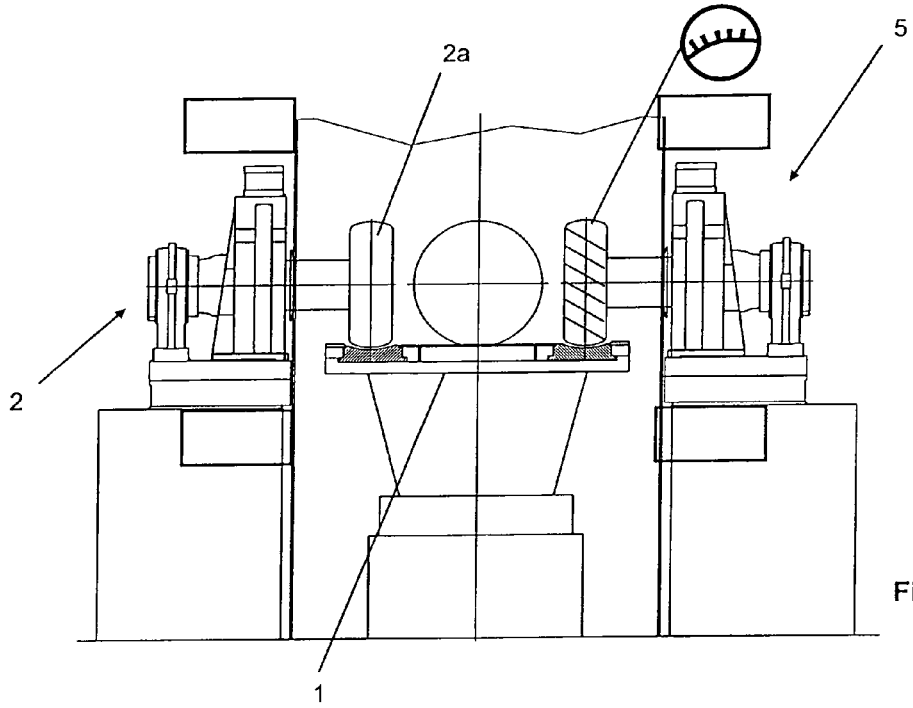
Figure 9B:
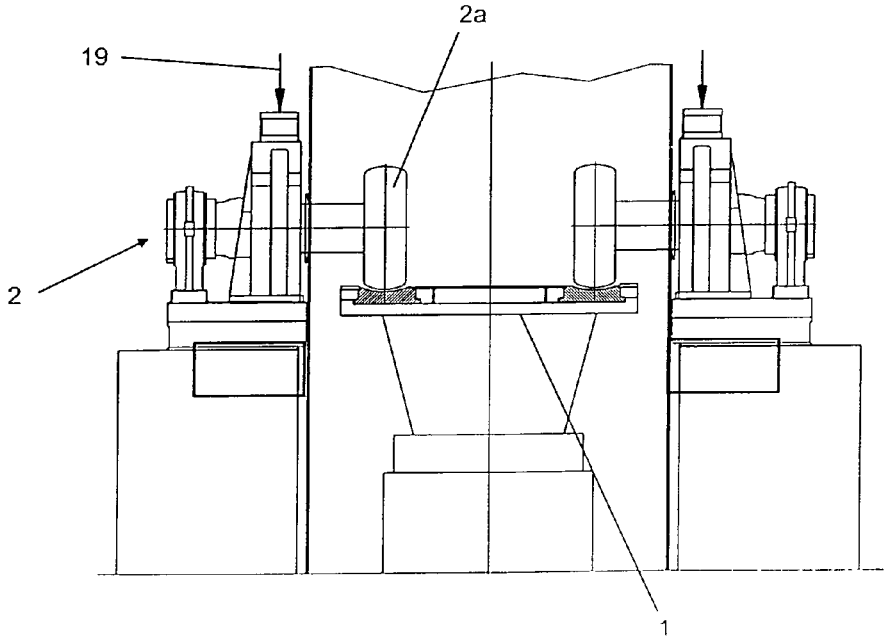

FIG. 9*a* shows a schematic side view of a drying and deagglomerating device before conversion into a mill drying device;

FIG. 9*b* shows a schematic side view of a mill drying device formed by conversion of the device shown in FIG. 9*a;*

Figure 8:
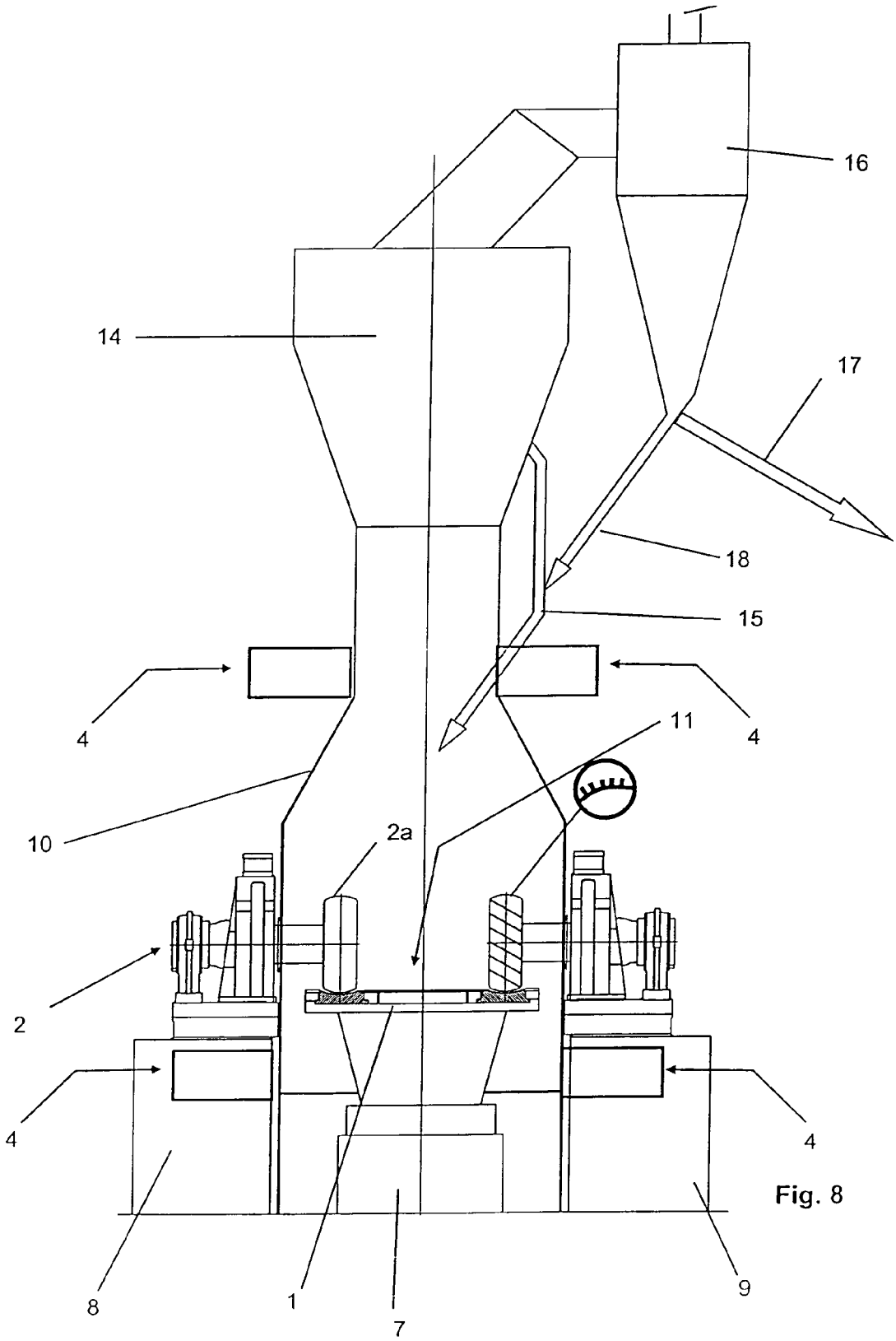
FIG. 8 shows a schematic view of a drying and deagglomerating device with a classifier.
Figure 10:
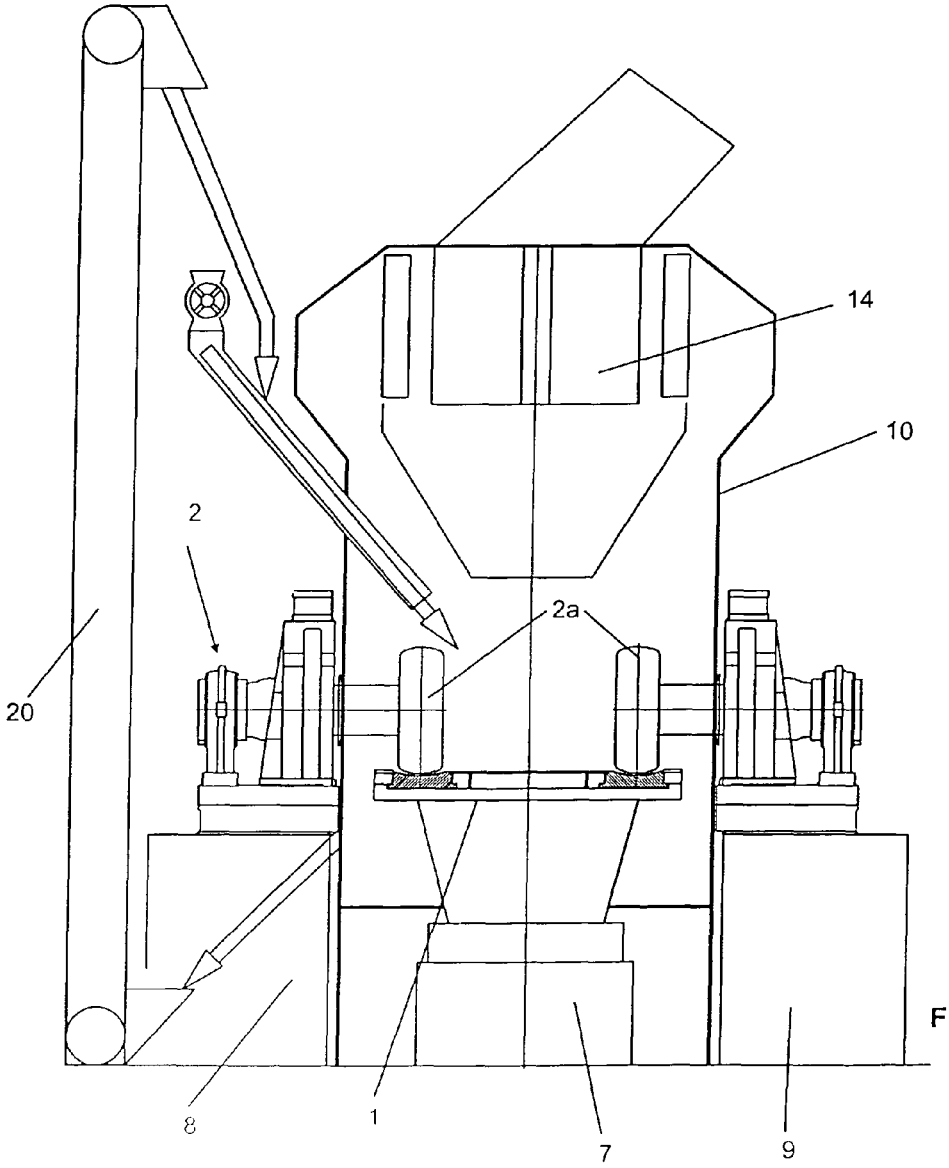

FIG. 10 shows a schematic side view of a mill drying device formed by conversion of the device shown in FIG. 8.

Figure 1A:
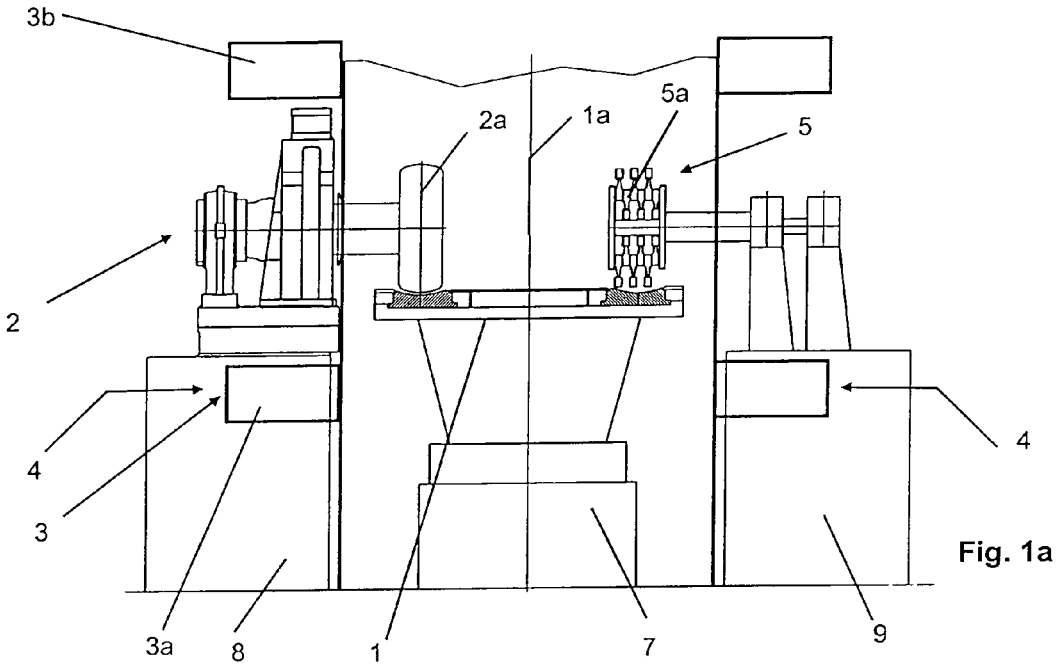
Figure 1B:
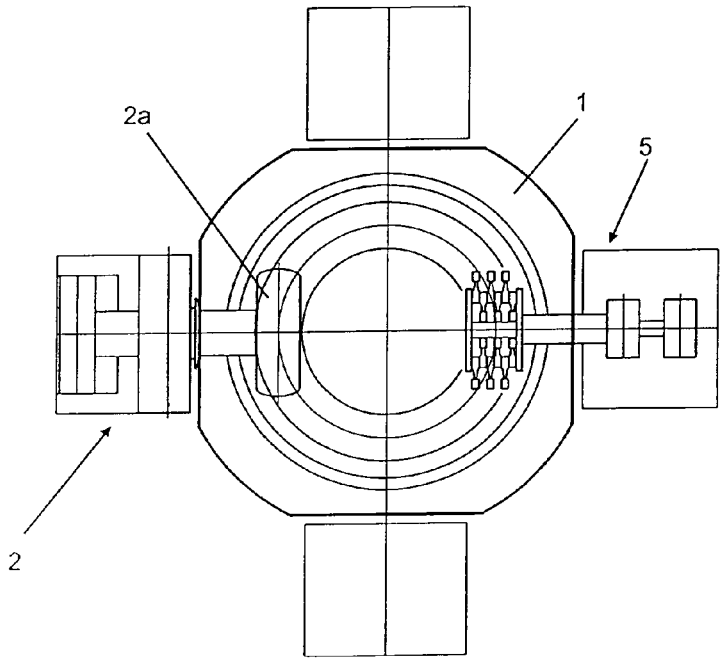

FIGS. 1*a* and 1*b* show a drying and deagglomerating device substantially comprising a drivable plate 1, a roller unit 2 with at least one roller 2*a* rolling on the plate for the purpose of kneading, mixing and breaking up a feed material, and means 3 for supplying hot gas 4 for drying the feed material.

Furthermore, means 5 are provided for detaching and breaking up the material bed forming on the plate 1. In the embodiment according to FIGS. 1*a* and 1*b*, these means 5 are formed by a hammer roller 5*a*, which is optionally driven in the opposite direction.

The plate 1 is supported on a pedestal 7 and has a driving device (not shown in further detail) by means of which the plate can be driven about its vertical longitudinal axis 1*a*. The roller unit 2 is supported on a pedestal 8, and the means 5 are mounted on a pedestal 9. The rollers 2*a* and the means 5 for detaching and breaking up the material bed forming on the plate are advantageously arranged diagonally opposite one another, as can be seen from FIG. 1*b*. Within the scope of the invention, however, further rollers and/or means for detaching and breaking up the material bed forming on the plate can also be provided.

Figure 2A:
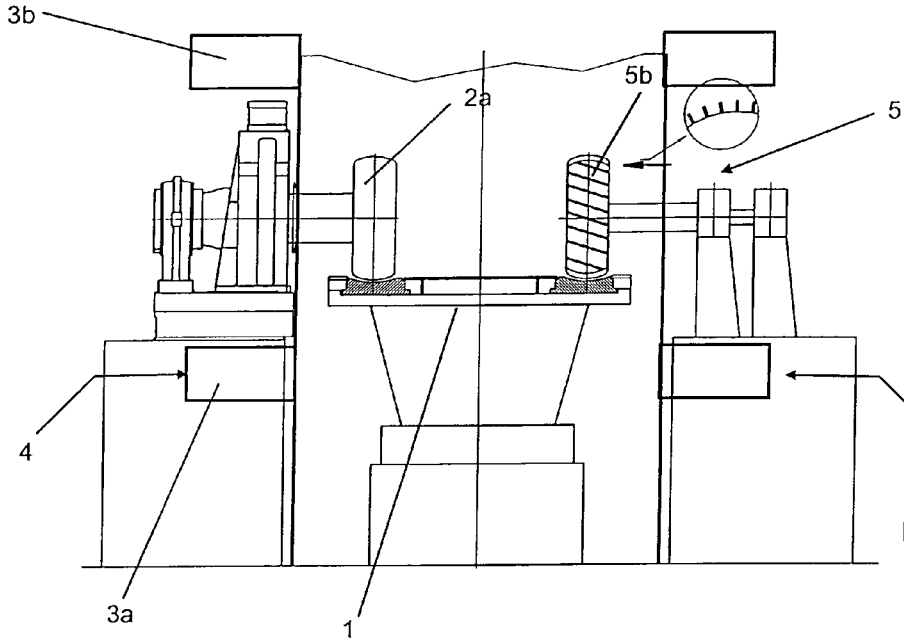
Figure 2B:
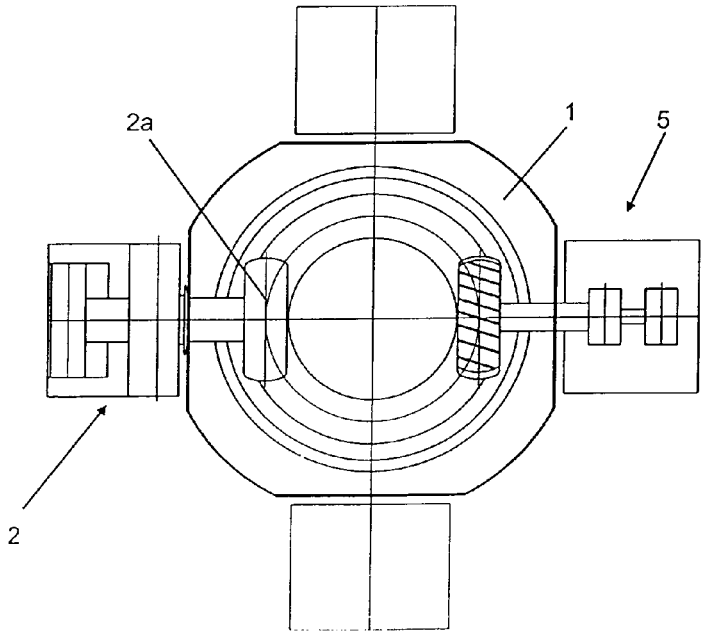
Figure 3A:
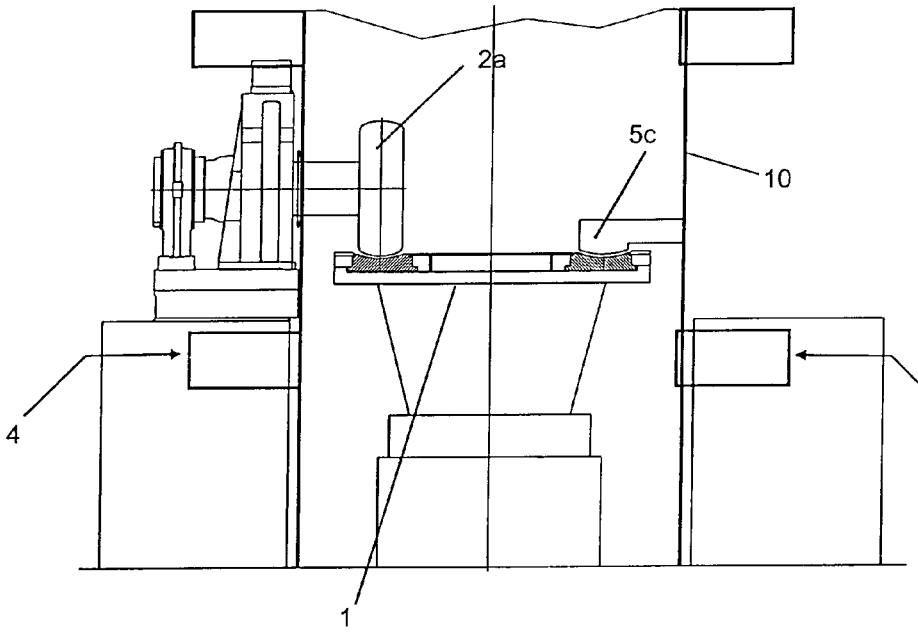
Figure 3B:
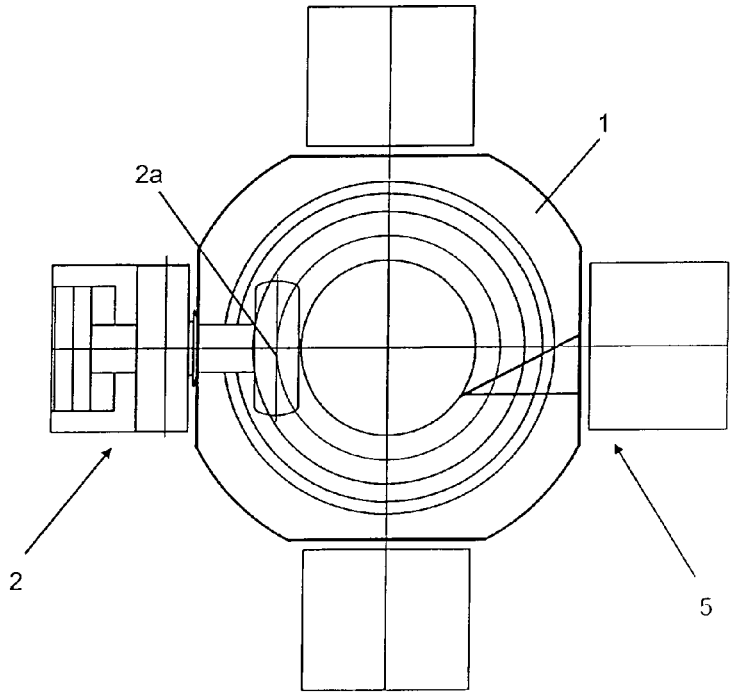

In the second embodiment according to FIGS. 2*a* and 2*b*, the means 5 for detaching and breaking up the material bed forming on the plate are formed by a toothed roller 5*b*. A further variant is shown in FIGS. 3*a* and 3*b*, in which the means are formed by a scraper 5*c* which can be fastened directly to the housing 10 of the device.

Figure 4:
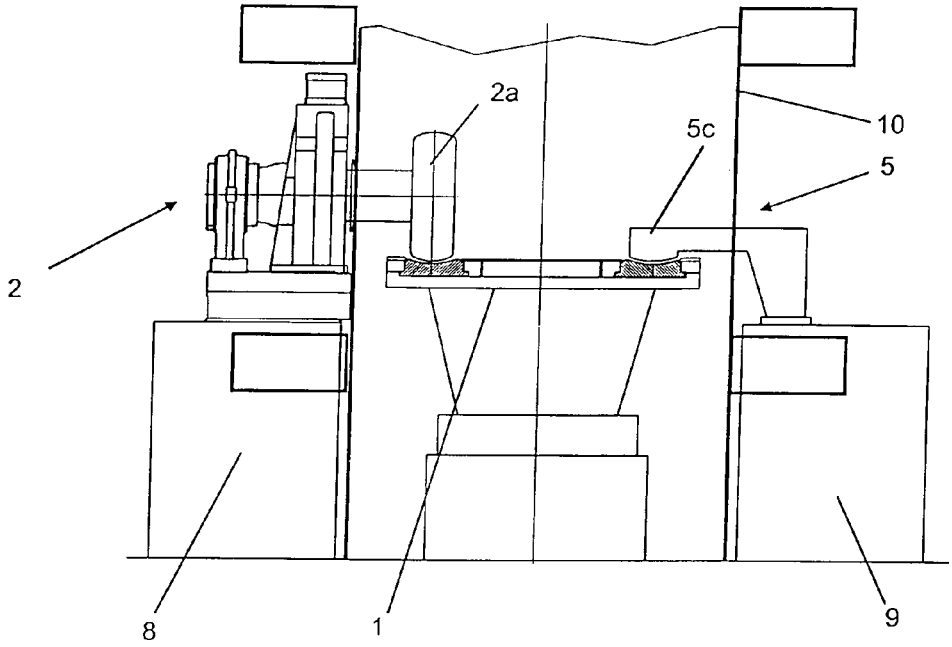
FIG. 4 shows a schematic side view of a drying and deagglomerating device according to a fourth embodiment.
Figure 5:
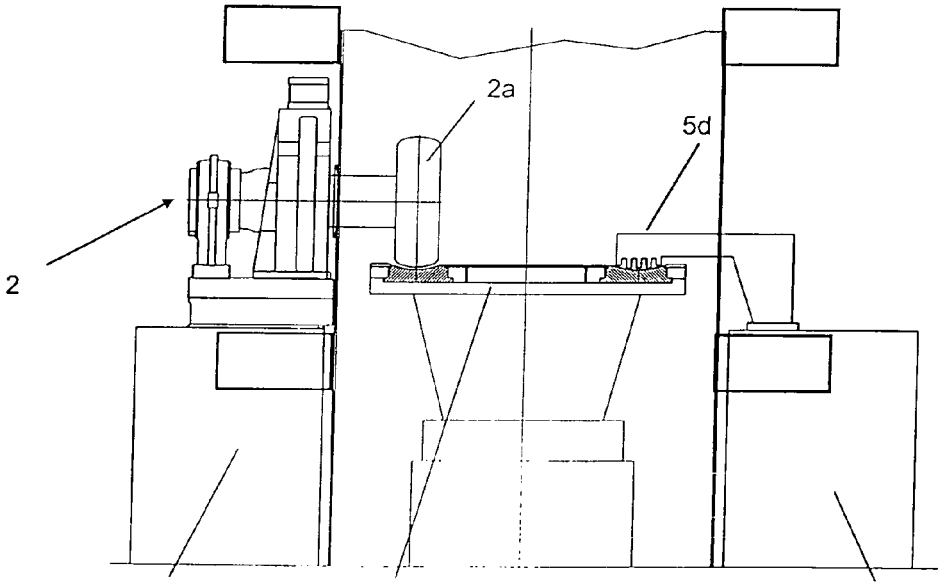
FIG. 5 shows a schematic side view of a drying and deagglomerating device according to a fifth embodiment.

In the embodiment according to FIG. 4, the means 5 are formed by a scraper 5*c* which is fastened not to the housing 10, but to the pedestal 9. Instead of a scraper, a rake 5*d* as shown in FIG. 5 is a further possibility.

Figure 6:
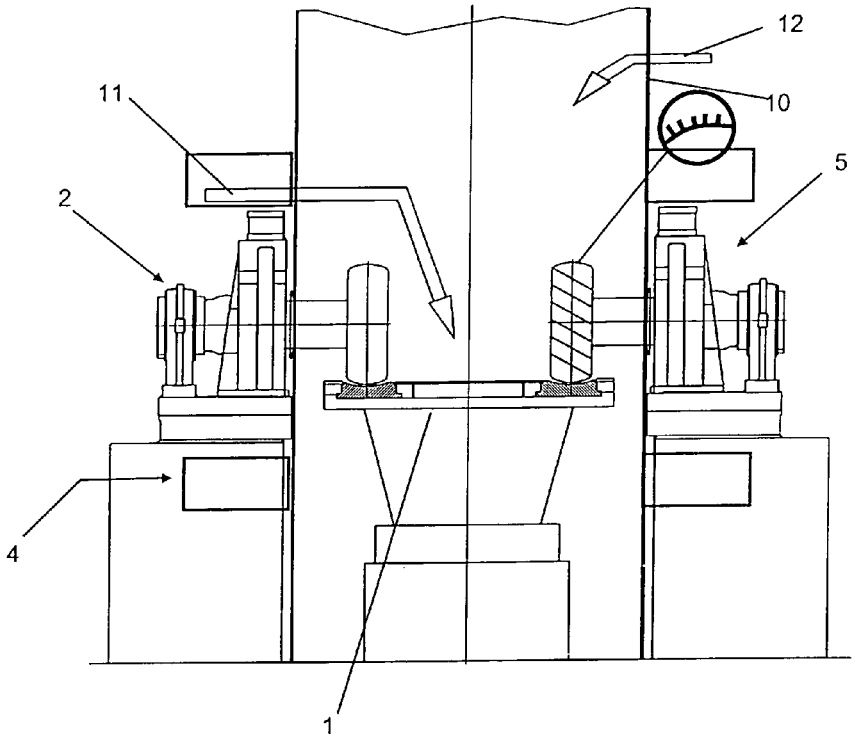
FIGS. 6 and 7 show schematic side views of two embodiments for supplying the feed material.

As shown in FIG. 6, the feed material can, for example, be fed directly to the plate 1 approximately in the region of the centre thereof by a feed device 11. A different or also additional feed point 12 can be provided in the upper region of the housing 10.

Furthermore, a stepped air supply can be provided in that first means 3*a* for supplying hot gas 4 are provided in the region of the grinding plate 1 and second means 3*b* for supplying hot gas are provided in a region above the at least one roller 2*a*. The temperature of the hot gas in the region of the grinding plate is less than 650° C., preferably approximately 450° C. to 550° C. The upper air supply can work with temperatures of at least 400° C., preferably in the range from 600° C. to 900° C.

Figure 7:
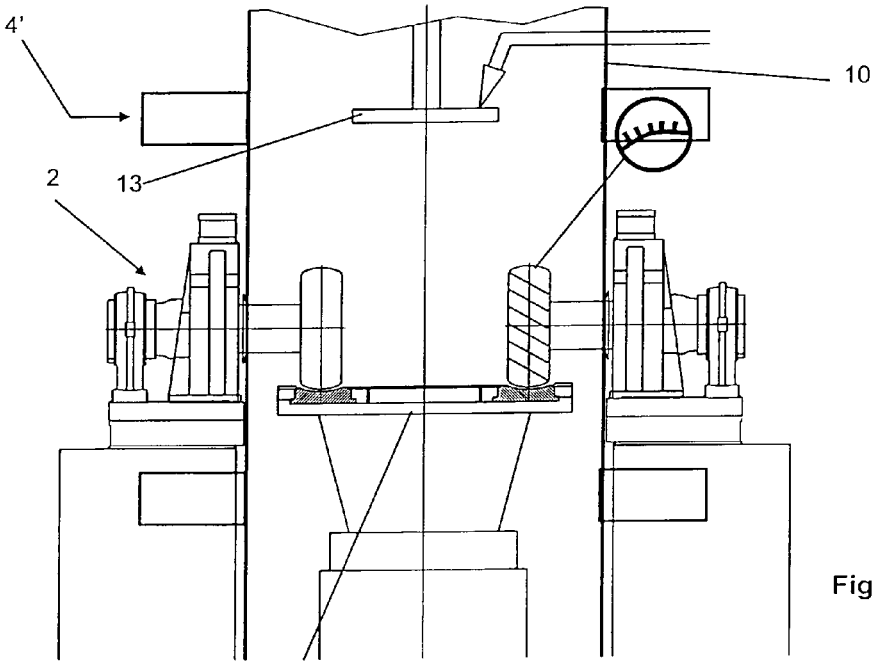

FIG. 7 shows a variant in which the feed material is fed to a distributing plate 13 arranged above the grinding plate 1. Advantageously, hot air 4' is simultaneously also supplied in this region. The feed material is then flung towards the incoming air by the distributing plate 13, and the fine dried material is carried upwards by the gas flow and the coarse material falls downwards from there onto the grinding plate and is picked up by the roller 2*a*.

The drying and deagglomerating device illustrated in FIG. 8 has a classifier 14 formed in the upper region of the housing 10. The feed material supplied by the means 11 passes under the roller 2*a* and is thereby kneaded, mixed and broken up. The material falling outwards over the edge of the plate 1 is picked up by the hot gas 4 flowing upwards from the bottom, whereupon the material is carried upwards and dried. Heavier particles immediately fall back again onto the grinding plate, while the other material passes into the classifier 14 arranged at the top.

The classifier, which is formed as a static or dynamic classifier, separates the material into fine material, which is conveyed upwards with the gas flow, and coarse material, which is fed back to the plate 1 via a line 15. The fine material passes together with the gas flow into a separator 16 which separates the gas from the fine material. The hot gas 4 is drawn off upwards, while the finished product can be discharged via a line 17. There is the possibility here of feeding some of the finished product back to the plate 1 via a line 18 in order to be able to adjust the moisture content of the material on the plate.

With the above-described device, it is possible to dry and deagglomerate relatively moist feed material which has a moisture content of, for example, 15% to 50%.

70% to 100% of the feed material has a particle size of less than 200 μm. The roller 2*a* therefore has to carry out substantially no grinding work. There is therefore also no need for a pressing device because the intrinsic weight of the roller 2*a* is sufficient for kneading, mixing and breaking up the feed material. The contact pressure of the roller 2*a* preferably lies in the range from 0 to 500 kN/m$^2$.

According to a particular embodiment of the invention, the above-described drying and deagglomerating device is formed so that it can be converted into a mill drying device at a later point in time, whilst retaining some of the components.

According to a preferred embodiment of the invention, the roller is therefore already formed as a grinding roller for later conversion of the device into a mill drying device. The plate is also formed as a grinding plate for later conversion. The pedestals 7, 8 and 9 are advantageously already designed so that they can continue to be used during later conversion of the device into a mill drying device. For conversion of the drying and deagglomerating device shown in FIG. 9*a* into a mill drying device shown in FIG. 9*b*, essentially only a pressing device indicated by an arrow 19 is then necessary, by means of which the roller 2*a* can be pressed onto the plate 1 formed as a grinding plate. In this case, the contact pressure of the roller 2*a* usually lies in a range from 300 to 1000 kN/m$^2$.

If means 5 for detaching and breaking up the material bed forming on the plate were provided at all in the drying and deagglomerating device, these are removed or replaced by at least one further roller unit with a pressing device. Preferably, up to four grinding rollers are provided on the plate 1.

If necessary, the driving device for the plate also has to be adapted to the conditions in a mill drying device.

FIG. 10 shows the completely constructed mill drying device. In this device, the part of the housing 10 above the roller units has been modified so that a dynamic classifier 14' can be provided there. As the material is discharged downwards, a bucket elevator 20 is also provided. Upon conversion of the drying and deagglomerating device shown in FIG. 8 into the mill drying device shown in FIG. 10, the pedestals 7, 8 and 9, the grinding plate 1 and the roller unit 2 can therefore be retained.

The above-described drying and deagglomerating device is distinguished by a very efficient working method. Furthermore, there is the possibility of relatively inexpensive conversion into a mill drying device.

The invention claimed is:

1. A method of drying and deagglomerating moist feed material, characterised in that at least 70% of the feed material has a particle size of less than 200 μm and the feed material has a moisture content of 15% to 50%, the feed material is kneaded, mixed and broken up by the action of at least one roller (2) rolling on a driven plate (1) and is dried by means of supplied hot gas and wherein the material bed forming on the plate is detached and broken up.

2. A method according to claim 1, characterised in that some of the feed material which has already been dried is fed back to the grinding plate.

* * * * *